United States Patent [19]

Haney et al.

[11] Patent Number: 4,867,236

[45] Date of Patent: Sep. 19, 1989

[54] COMPACT CASING TONGS FOR USE ON TOP HEAD DRIVE EARTH DRILLING MACHINE

[75] Inventors: Keith M. Haney; Jerry K. Lingafelter, both of Wichita Falls, Tex.

[73] Assignee: W-N Apache Corporation, Wichita Falls, Tex.

[21] Appl. No.: 254,422

[22] Filed: Oct. 6, 1988

Related U.S. Application Data

[63] Continuation-in-part of Ser. No. 107,268, Oct. 9, 1987, abandoned.

[51] Int. Cl.[4] ..... E21B 3/02

[52] U.S. Cl. ..... 166/77.5; 175/170; 81/57.33; 81/57.35

[58] Field of Search ..... 175/170, 171, 85; 166/77.5, 78, 85; 173/163; 294/110.1, 116; 82/4 C; 81/57.18, 57.21, 57.33, 57.34, 57.35

[56] References Cited

U.S. PATENT DOCUMENTS

| | | | |
|---|---|---|---|
| 1,200,612 | 10/1916 | Helm . | |
| 1,292,747 | 1/1919 | Foster . | |
| 1,740,377 | 12/1929 | Snyder et al. . | |
| 2,016,652 | 10/1935 | Poole . | |
| 2,181,641 | 11/1939 | Hicks . | |
| 3,129,013 | 4/1964 | Thompson et al. | 279/109 |
| 3,550,485 | 12/1970 | Dickmann . | |
| 3,610,640 | 10/1971 | Bollin et al. . | |
| 3,766,991 | 10/1973 | Brown | 175/85 |
| 3,776,320 | 12/1973 | Brown . | |
| 3,793,913 | 2/1974 | Wilms . | |
| 4,291,598 | 9/1981 | Cherry . | |
| 4,357,843 | 11/1982 | Peck . | |
| 4,511,169 | 4/1985 | Willis . | |
| 4,522,439 | 6/1985 | Haney . | |
| 4,576,254 | 3/1986 | Cox . | |
| 4,650,236 | 3/1987 | Haney et al. . | |
| 4,709,604 | 12/1987 | Rogers . | |
| 4,762,187 | 8/1988 | Haney . | |

FOREIGN PATENT DOCUMENTS

| | | |
|---|---|---|
| 2706940 | 8/1978 | Fed. Rep. of Germany . |

*Primary Examiner*—Jerome W. Massie
*Assistant Examiner*—Terry Lee Melius
*Attorney, Agent, or Firm*—Willian Brinks Olds Hofer Gilson & Lione

[57] ABSTRACT

Compact casing tongs include a tube which is secured to a connector, the connector in turn being supported and rotated by a quill of a top head drive assembly. The lower end of the tube regidly supports a set of cams which define multiple recesses. A jaw is mounted in each recess, and each of the jaws is connected to a brake ring positioned outside the tube. By externally braking the brake ring while the quill connector body is rotated the jaws are shifted out of the recesses to grip the exterior of a casing positioned within the tube. The tube is dimensioned to ensure that the jaws engage the body of the casing beneath the upper collar of the casing.

32 Claims, 6 Drawing Sheets

COMPACT CASING TONGS FOR USE ON TOP HEAD DRIVE EARTH DRILLING MACHINE

This is a continuation-in-part of U.S. patent application Ser. No. 07/107,268, filed Oct. 9, 1987, now abandoned.

BACKGROUND OF THE INVENTION

The present invention is directed to improved casing tongs which are adapted to be suspended from a top head drive assembly in an earth drilling machine and can be used to grip and rotate casing.

Earth-drilling machines are used to make up a large number of threaded connections in the assembly of strings of casing and other down hole tubulars. Various types of tools have been used for this purpose in the past, including tools mounted to move with a top head drive assembly and tools mounted to remain on the floor of the drilling machine.

Tools of the first type are shown in U.S. Pat. Nos. 4,511,169, 4,522,439, and 4,650,236, all assigned to the assignee of the present invention. Each of these devices is adapted to be threaded to a quill included in the top head drive assembly for rotation by the quill, and each includes means for engaging the upper end of a length of downhole tubular. The devices shown in these patent documents include movable jaws which are primarily adapted for lifting and supporting the downhole tubular. These tools are limited in the maximum torque that can be transmitted to the tubular.

The tools shown in U.S. Pat. Nos. 4,650,236 and 4,762,187 (also assigned to the assignee of this invention) include a seal for plugging and sealing the upper end of the tubular, and a passageway for introducing drilling fluid into the tubular. These features provide important blowout protection, as explained in detail in the specifications.

The devices described above provide important advantages in operation. Nevertheless, none of these devices uses cammed jaws operating on the exterior surface of the downhole tubular as described below, and such an arrangement provides particular advantages for casing tongs.

Cammed jaws have been used in a variety of other applications. For example, Wilms U.S. Pat. Nos. 3,793,913, Dickmann 3,550,485, and Peck 4,357,843 all relate to power tongs for an earth-drilling apparatus. In each case, the power tongs are intended to be located on the drilling floor, and they are moved into and out of alignment with the drill string as necessary. Wilms discloses a three-lobed, bidirectional cam which advances and retracts three jaws into engagement with a downhole tubular. A shown in FIG. 2 of the Wilms patent, this device is typically used with the lower rather than the upper end of the tubular. Disc brakes are positioned within the device to advance the jaws into contact with the tubular, and hydraulic motors and cylinders are used to rotate the clamped tubular. The Dickmann and Peck devices are in many respects similar to the Wilms device.

Each of these three power tongs is a heavy, large, complicated and expensive apparatus that takes up considerable space on the drilling floor, and which requires a prime mover which is separate from the prime mover used to rotate the drill string during drilling operations. Because these power tongs are situated on the drilling floor, they must be aligned properly with the drilling axis. Furthermore, they cannot provide blowout protection because they are not in communication with the interior of the clamped tubular. This is a direct consequence of the fact that these tongs work with the lower rather than the upper end of the clamped tubular.

Cam-driven jaws have also been used with hydraulic actuated slip assemblies (Cox U.S. Pat. No. 4,576,254) and with various chucks for pipes and the like, as shown in the following patents:

| U.S. Pat. No. | Inventor |
|---|---|
| 3,610,640 | Bollin et al |
| 2,016,652 | Poole |
| 1,740,377 | Snyder |
| 1,292,747 | Foster |
| 1,200,612 | Helm |

None of the patents and patent applications described above provides the important advantages of cam-operated jaws operating on the exterior surface of a casing in an apparatus mountable to a top head drive assembly.

SUMMARY OF THE INVENTION

According to this invention, compact casing tongs are provided for an earth drilling machine of the type comprising a mast and a top head drive assembly movable along the mast, wherein the top head drive assembly comprises a quill and means for rotating the quill. The casing tongs of this invention comprise a rigid tube having an upper end and a lower end, and the tube is sized to receive and surround an upper end of a length of casing which comprises a casing body and a casing collar. A mating element is secured to the upper end of the tube and is shaped to engage the quill to support the tube from the quill such that rotation of the quill causes rotation of the tube. A plurality of jaws are provided, each configured to engage an exterior surface of the casing body, and these jaws are supported in the tube for limited rotational and radial movement. The supporting means comprises a plurality of cams, each positioned adjacent a respective one of the jaws, and each shaped to shift the respective jaw radially in response to relative rotation between the cam and the respective jaw. Brake means are coupled between the jaws and a nonrotating element external to the tube for selectively retarding rotation of the jaws when the tube is rotated by the quill and the brake means is set. The supporting means and the brake means cooperate to shift the jaws radially inwardly to clamp the casing body for rotation when the tube is rotated by the quill and the brake means is set.

As pointed out above, the tube is dimensioned to ensure that the jaws engage the casing body rather than the casing collar. This arrangement allows excellent control over the torque applied to the threaded joint between the lower end of the casing body and the collar of the downwardly adjacent casing.

Preferably, the mating element defines a bore extending therethrough to receive drilling fluid from the quill, and the casing tongs include a threaded element positioned within the tube and configured to engage and seal against the upper end of the casing collar. The threaded element conducts drilling fluid from the bore into the casing body when the threaded element is engaged with the casing collar.

As pointed out in greater detail below, the casing tongs of this invention provide important advantages. No external prime mover is required to rotate the clamped casing, since the casing tongs are supported directly from the quill of the top head drive assembly of the drilling machine. The design described below is well suited for high speed automatic operation, thereby reducing the number of drilling personnel required to operate the drilling machine. The casing tongs engage the upper end of the body of the clamped casing, and provide excellent blowout protection. In the event of a threatened blowout, the casing tongs can be sealed against the upper end of the collar of the clamped casing and drilling fluid can be pumped into the string. The design set out below is much smaller and less complicated than the power tongs described above. The casing tongs of this invention are automatically centered because they are mounted to the quill of the top head drive assembly, and thus they are simply and reliably positioned as desired with respect to the drilling axis, without bulky and expensive positioning devices.

The invention itself, together with further objects and attendant advantages, will best be understood by reference to the following detailed description, taken in conjunction with the accompanying drawings.

DETAILED DESCRIPTION

Figure 1:
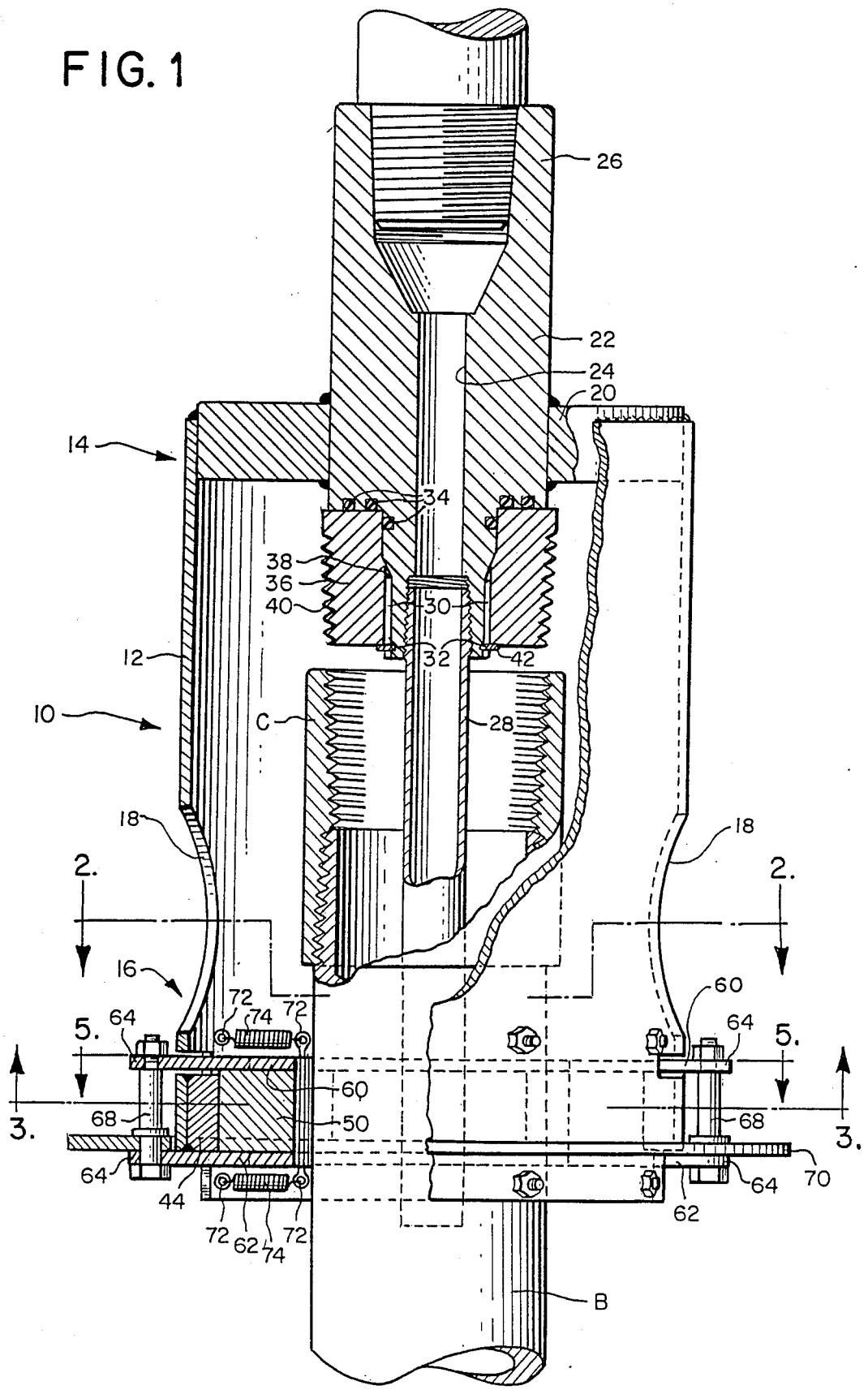
FIG. 1 is a longitudinal section of a first embodiment of this invention.

Turning now to the drawings, FIG. 1 shows a gripping device 10 which incorporates a first embodiment of the casing tongs of this invention. This device 10 is used to grip and rotate a length of casing which is made up of a casing body B that is threadedly connected to a casing collar C. The device 10 includes as a principal structural element a torque tube 12 which defines an upper end 14 and a lower end 16. In this embodiment, a pair of access ports 18 are positioned in a side wall of the tube 12 between the upper and lower ends 14,16.

The upper end 14 of the tube 12 is rigidly secured to an annular plate 20, which is in turn rigidly secured to a mating element in the form of a quill connector body 22. The quill connector body 22 defines a central passageway 24 which is in fluid communication at its upper end with a threaded box end joint 26 and at its lower end with an injector tube 28. The lower end of the quill connector body 22 extends through the plate 20 into the interior of the tube 12 and defines an array of splines 30, an annular groove 32, and a set of O-ring seals 34.

As best shown in FIG. 1, a seal plug 36 is removably mounted on the lower end of the quill connector body 22. The seal plug 36 defines an array of internal splines 38 shaped to mate with the external splines 30 on the quill connector body 22. In addition, the seal plug 36 defines a set of external threads 40 configured to mate with the internal threads of th collar C of the length of casing inserted within the tube 12. The seal plug 36 is held in place by a retaining ring 42 mounted in the groove 32. When the retaining ring 42 is installed, the seal plug 36 seals against the O-ring seals 34 to prevent the passage of drilling fluid between the seal plug 36 and the quill connector body 22.

Figure 3:
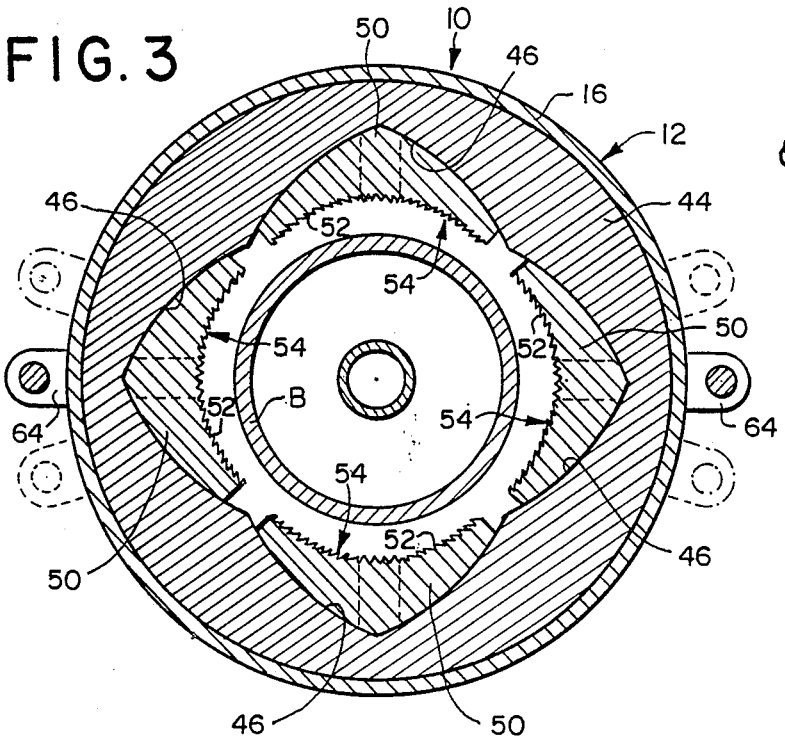
FIG. 3 is a cross section taken along line 3—3 of FIG. 1.

As best shown in FIG. 3, a cam 44 is rigidly mounted to the lower end 16 of the tube 12 within the tube 12. This cam 44 defines a plurality of recesses 46, each shaped to receive a respective jaw as described below. In this embodiment four recesses 46 are provided, though a greater or lesser number can be used. Each of the recesses 46 has the cross-sectional shape of a pointed arch, which will be referred to as "ogival" herein.

The components of the casing tongs 10 described above form a rigid assembly adapted to be supported from the quill of a top head drive assembly, without relative movement between any of these components.

Figure 2:
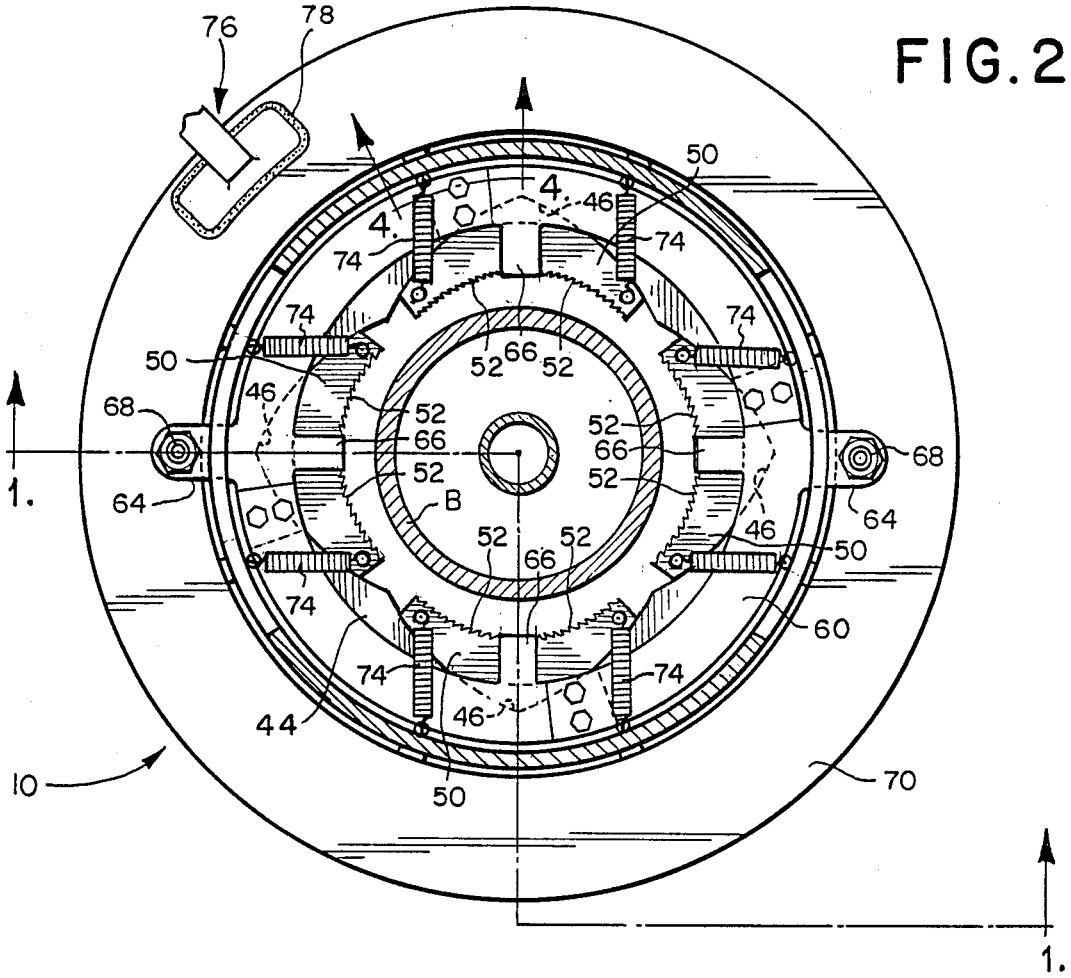
FIG. 2 is a cross section taken along line 2—2 of FIG. 1.

As best shown in FIGS. 2 and 3, a plurality of jaws 50 are positioned, each within a respective recess 46 of the cam 44. Each of the jaws 50 defines an array of teeth 52 on an inner arcuate cylindrical surface 54. Each of the jaws 50 also defines an outer surface which is ogival in shape and which is shaped to fit into the respective recess 46. The jaws 50 also define pairs of opposed recesses 58. These recesses 58 are oriented radially when the jaws are positioned in the recesses 46 as shown in FIG. 2.

Figure 4:
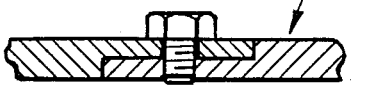
FIG. 4 is a section taken along line 4—4 of FIG. 2.
Figure 6:
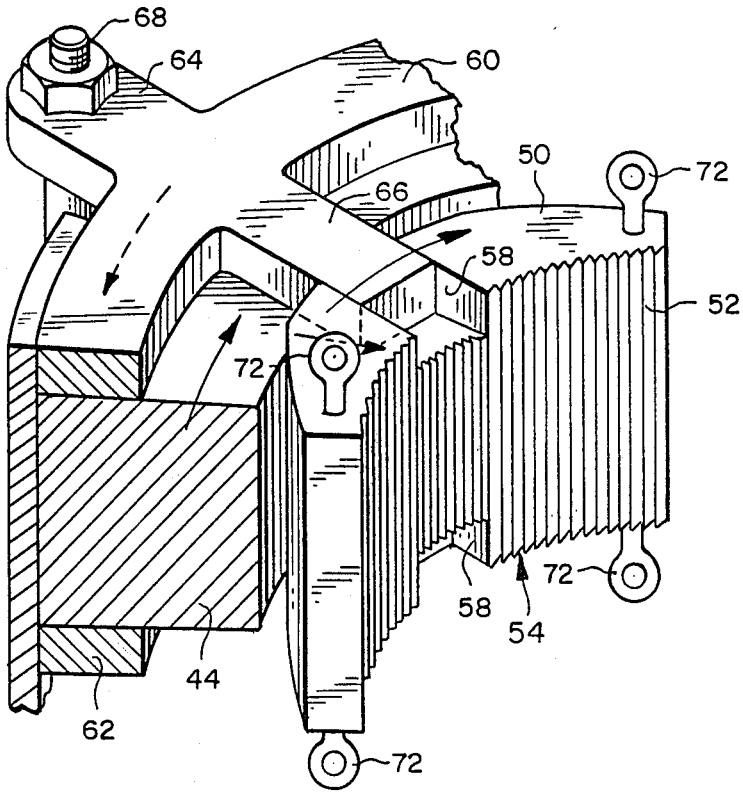
FIG. 6 is a fragmentary perspective of a jaw and associated components of the embodiment of FIG. 1.
Figure 7:
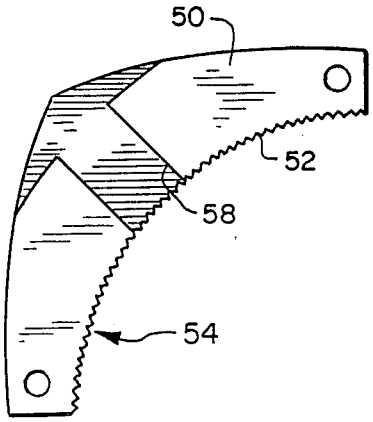
FIG. 7 is a plan view of the jaw of FIG. 6.

As shown in FIGS. 2 and 6, the jaws 50 are supported in place and rotated with respect to the cam 44 by a pair of rings, including an upper shift ring 60 and a lower shift ring 62. The two rings 60,62 define a pair of outer tabs 64 which extend outside of the tube 12, and a set of jaw engaging elements 66 which project radially inward. For ease of assembly the upper shift ring 60 is made in four separate segments which are fastened together by bolts, as shown in FIG. 4.

The upper and lower shift rings 60,62 are held together by bolts 68. When the shift rings 60,62 are secured together by the bolts 68 the jaw engaging elements 66 are loosely positioned within the slots 58 of the jaws 50. In this way, the jaws 50 are engaged with the shift rings 60,62 for rotation, yet the jaws 50 are free to move radially.

Figure 5:
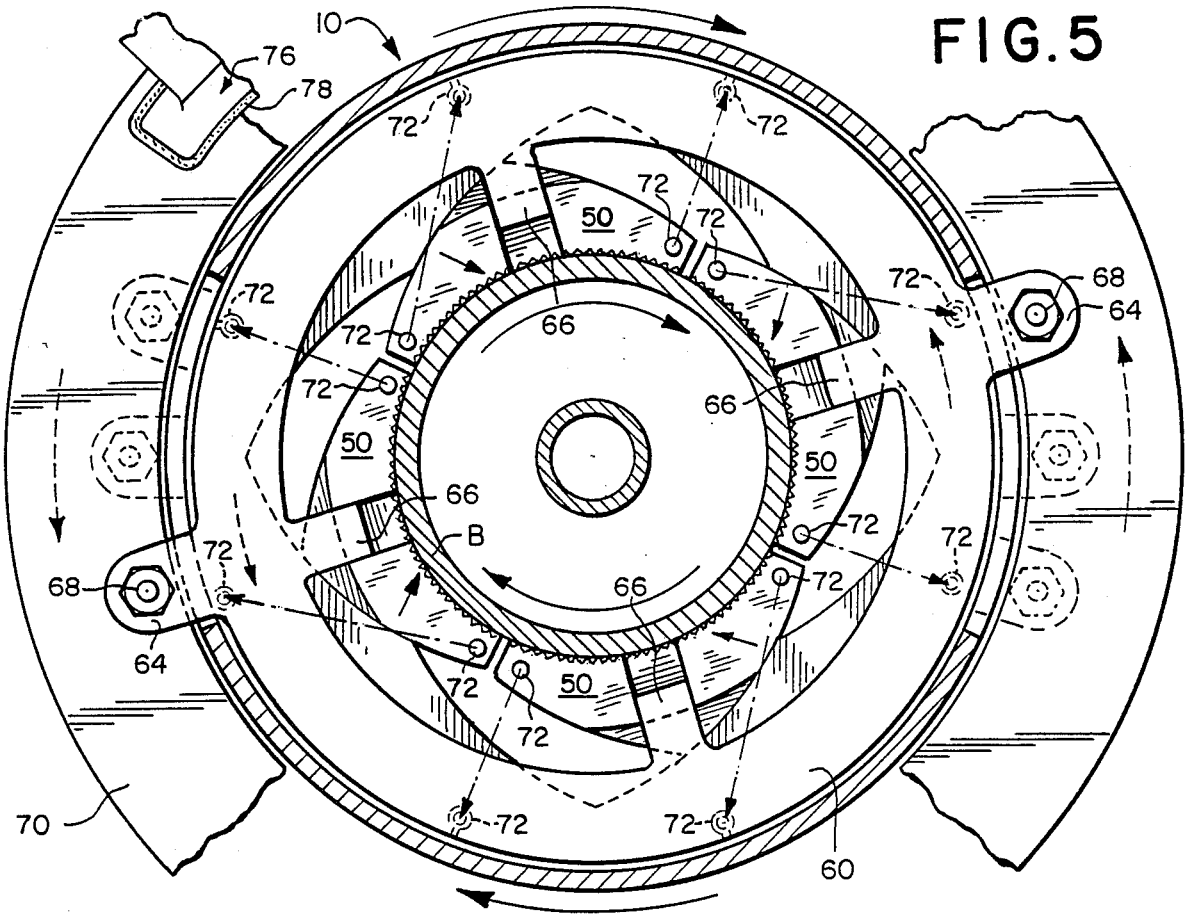
FIG. 5 is a cross section taken along line 5—5 of FIG. 1.

As shown in FIGS. 1, 2 and 5, the bolts 68 also secure a brake ring 70 in the form of a brake disk to the shift rings 60,62 such that the brake ring 70 and the shift rings 60,62 rotate in unison. Eye bolts 72 are mounted to the interior of the tube 12 and to the jaws 50, and springs are mounted between respective pairs of the eye bolts 72. These springs 74 resist extension and bias the jaws 50 to the retracted position shown in FIG. 2, in which the jaws 50 are centered in the respective recesses 46.

Merely by way of example, the following details of construction are provided in order better to define the structure of the gripping device 10. In this embodiment, each of the jaws 50 moves through a radial stroke of 1 inch when rotated by $16\frac{1}{2}°$ with respect to the cam 44. The recesses 46 of the cam 44 are configured to maintain the inner surfaces 54 of the jaws 50 concentric with the center line of the tube 12 as the jaws 50 move throughout the range of travel. The jaws 50 may be provided with an inner surface 54 adapted to clamp casing having an external diameter of 9⅝ inches.

Figure 8:
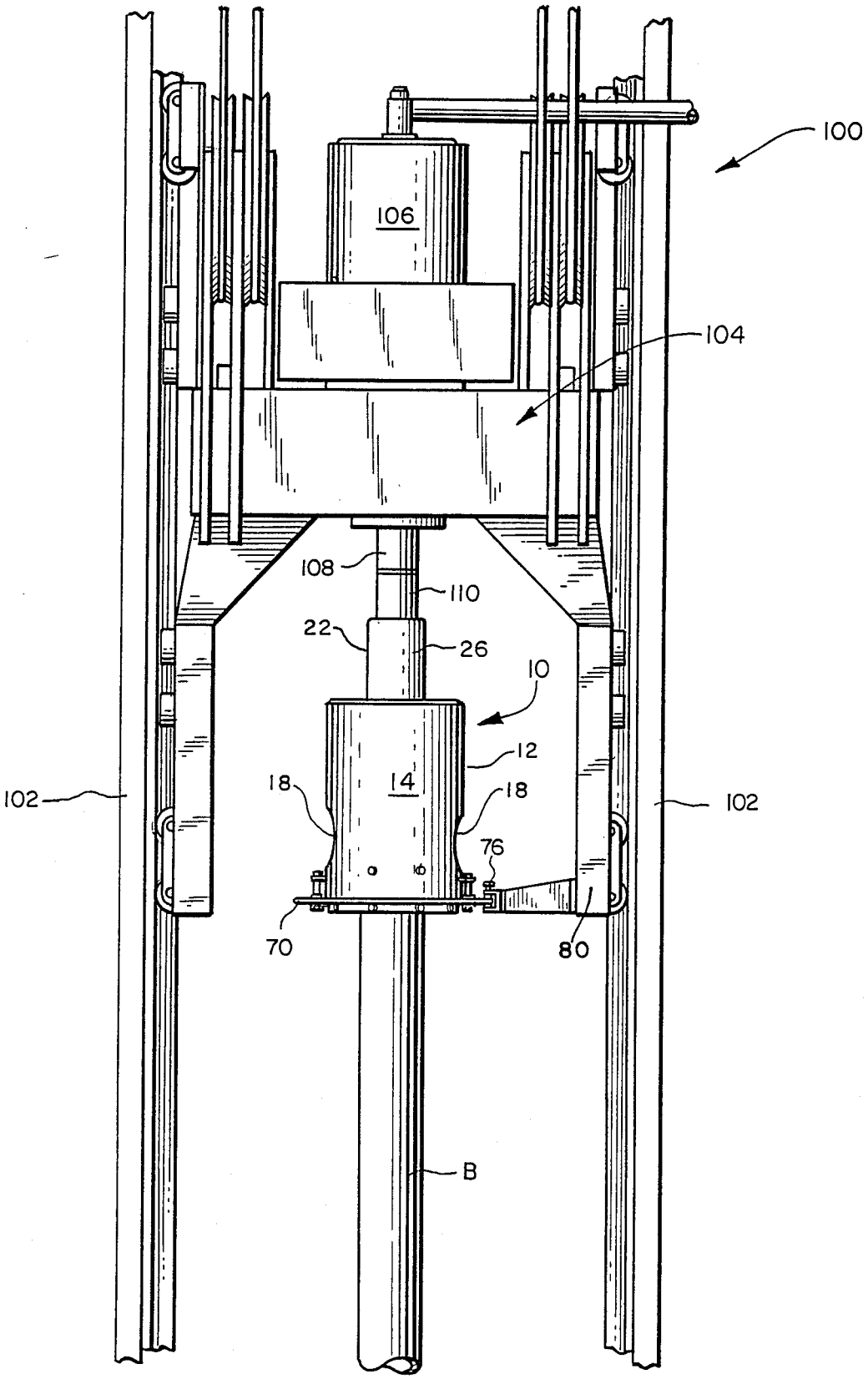
FIG. 8 is an elevation of the embodiment of FIG. 1 in use.

FIG. 8 shows an elevational view of the casing tongs 10 in use with a drilling machine 100 that includes a mast 102 and a top head drive assembly 104. The top head drive assembly 104 is guided for movement along the mast 102 and includes means such as an electric motor 106 for rotating a quill 108. The quill 108 has a central passageway (not shown) for introducing fluids such as drilling mud into a string of tubulars such as casing.

Top head drive assemblies are conventional in the art and form no part of this invention. One suitable top head drive assembly is described in U.S. Pat. No. 4,314,611, assigned to the assignee of the present invention. This patent should be referenced for a fuller understanding of the structure and operation of a top head drive assembly.

The casing tongs 10 (specifically the threaded end 26 of the quill connector body 22) are threadedly engaged at the lower end of the quill 108, or to the lower end of an adaptor sub 110 which is in turn threadedly connected to the quill 108. The size and number of the adaptor subs 110 is entirely dependent on the particular application, and where appropriate the term "quill" will be used to designate both the quill 108 and the assembly of the quill 108 and one or more adaptor subs 110.

A hydraulic disc brake 76 having a pair of friction pads 78 is mounted to a non-rotating framing member 80 of the top head drive assembly 104 so as not to rotate with the quill 108. This brake 76 is positioned to engage the brake ring 70 frictionally, with the friction pads 78 bearing directly on the brake ring 70 (FIG. 5).

When the brake 76 is released and no casing is positioned within the casing tongs 10, the springs 74 bias the jaws 50 to a retracted position as shown in FIG. 2. When it is desired to grip a length of casing with the casing tongs 10, the top head drive assembly 104 is lowered so as to lower the casing tongs 10 over the upper end of the casing. At this point, the casing is supported by other means such as a transfer arm or slips (not shown). Preferably, the tube 12 is dimensioned to ensure that the collar C can fit entirely within the tube 12 such that the jaws 50 engage the casing body B rather than the casing collar C. In this way, torque can be applied directly to the casing body B.

The brake 76 is then set and the top head drive assembly 104 is used to rotate the casing tongs 10 in the appropriate direction either to make up or to break out the casing body B. The drag of the brake 76 on the brake ring 70 shifts the brake ring 70 and therefore the shift rings 60,62 and the jaws 50 with respect to the cam 44 (FIG. 5). In this way, the jaws 50 are moved out of the recesses 46 toward the casing body B. This inward movement of the jaws 50 continues until the teeth 52 engage the exterior of the casing body B. At this point, the jaws 50 become self-applying, and they securely grip the casing body B. Preferably, the brake is released at this time. The top head drive assembly 104 can then be used to supply the desired torque at the desired rotational speed so as to make up or break out the casing body B with the collar of another length of casing (not shown) situated adjacent the lower end of the casing body B.

When the casing body B is to be released, the brake 76 is re-applied and the top head drive assembly 104 is controlled to rotate the casing tongs 10 a short distance in the reverse direction. This reverse rotation releases the jaws 50 from the casing body B, thereby allowing the springs 74 to return the jaws 50 to the retracted position shown in FIG. 2.

It should be recognized that the recesses 58 and the jaws 50 are configured to grip the casing body B in either the make up or break out direction. Thus, the casing tongs 10 are fully bidirectional.

Figure 9:
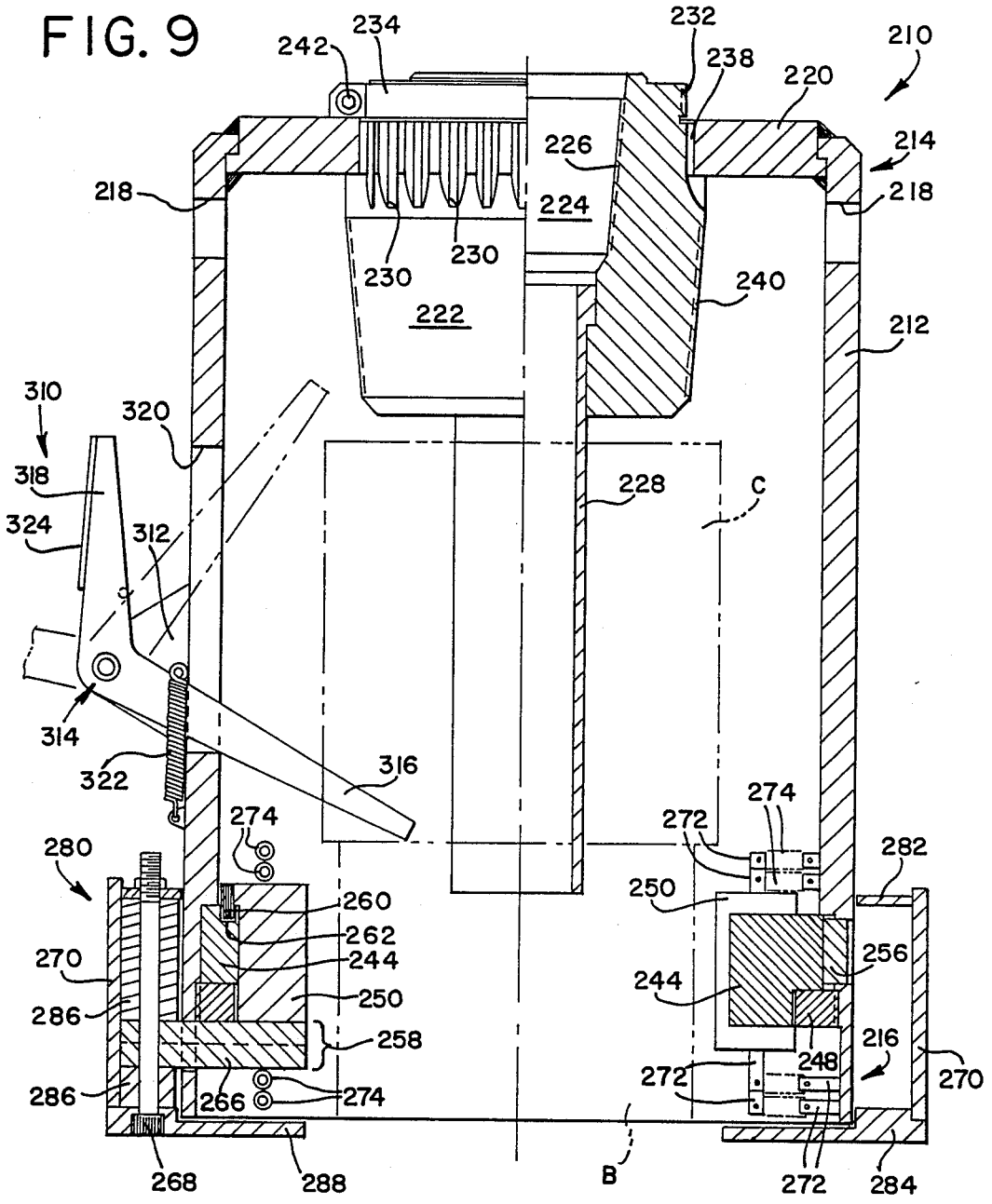
FIG. 9 is a longitudinal section of a second embodiment of this invention taken along line 9—9 of FIG. 10.
Figure 10:
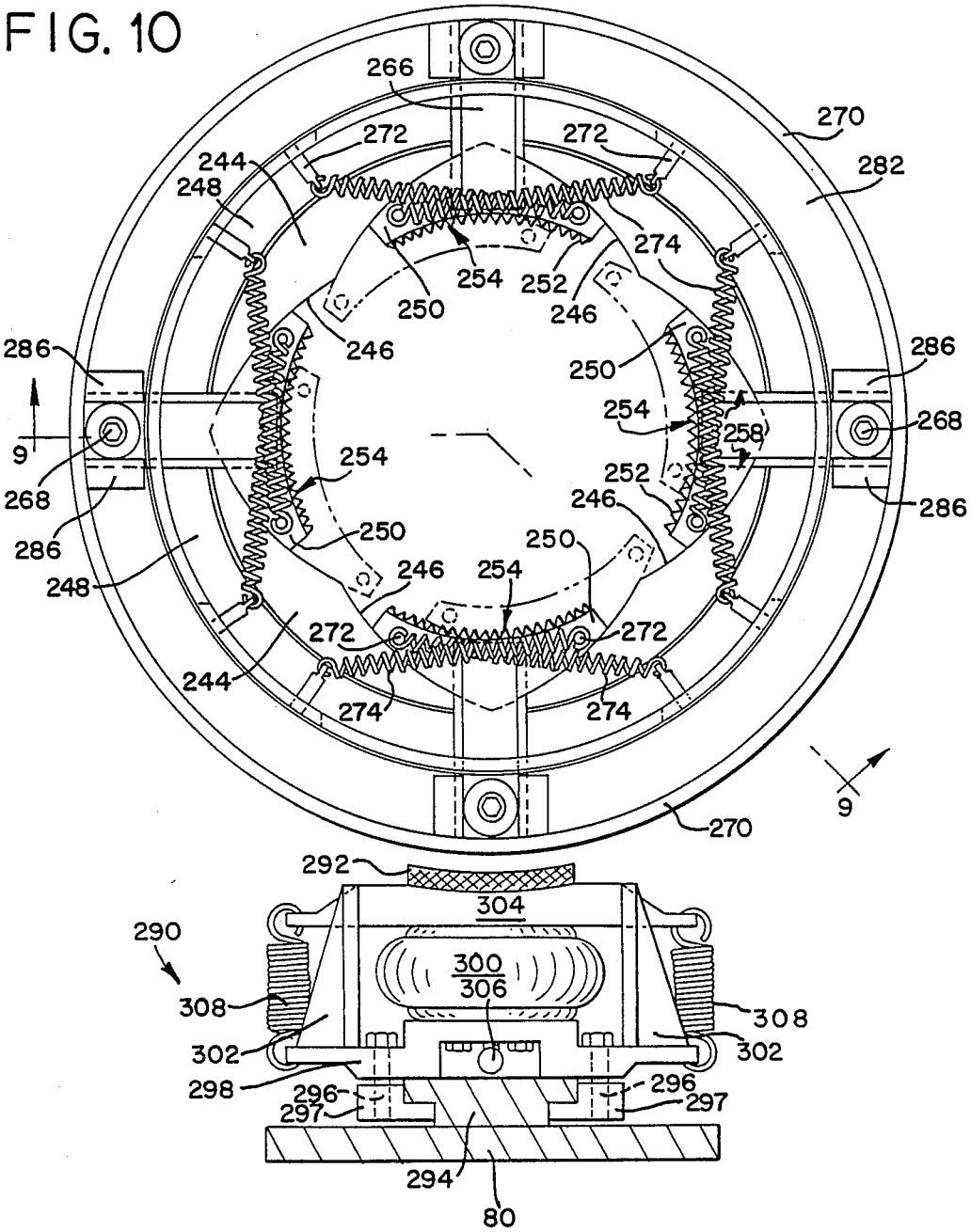
FIG. 10 is a bottom view of the lower end of the embodiment o FIG. 9, the lower brake assembly ring 284 having been removed for illustration.

FIGS. 9–10 show a second and presently preferred embodiment of casing tongs of the current invention. Gripping device 210 is used to grip and rotate a length of casing which is made up of a casing body B that is threadedly connected to a casing collar C. The device 210 includes as a principal structural element a torque tube 212 which defines an upper end 14 and a lower end 16. In this embodiment, a pair of ports 218 are positioned in a side wall of the tube 212, preferably proximate the upper end 214. The ports 218 are useful for being engaged by a spaner wrench for unscrewing the casing tongs from a top head drive.

An annular plate 220 is rigidly secured to the upper end 214 of the tube 212. A central opening in the plate 220 is provided with splines 238.

An adaptor 222 is releasably received in the opening of the annular plate 220 and is secured to the plate 220, as by means of adaptor nut 234 having a cap screw 242. The adaptor nut 234, which is not illustrated in the right-hand half of the drawing, is substantially annular. It is provided with internal threads for engagement with threads 232 of adaptor 222. On the left in the drawing, nut 234 is split. After being threaded onto the threads 232 of adaptor 222, cap screw 242 is tightened to secure the nut 234 in place. Desirably, two small lands (one of which is shown) are machined in the surface of the nut 234 to provide a convenient seat for the cap screw 242.

Adaptor 222 is provided with splines 230 that cooperate with splines 238 of annular plate 220 to provide positive rotational drive.

Adaptor 222 defines a central passageway 224 which is in fluid communication at its lower end with an injector tube 228 and at its upper end with a quill 108 or the like, received in the upper portion of passageway 224. For this purpose, threads 226 are provided in passageway 224 to engage threads of the quill, whereby the tongs may be suspended from the quill. The lower portion of adaptor 222 within the tube 212 is provided with external threads 240.

A cam 244 is received in the lower end 216 of the tube 212 and secured in place by annular cam nut 248, which is threaded on its external circumference for threaded engagement with tube 212. If desired, cam 242 may easily be removed by unthreading cam nut 248. Key 256 is received within openings in tube 212 and cam 244. It serves to prevent relative rotation of the cam 242 and tube 212 about the central axis of the assembly.

Cam 242 defines a plurality of recesses 246, each shaped to receive a respective jaw as described below. In this embodiment, four recesses 246 are provided, although a greater or lesser number can be used. Each of the recesses 246 has an ogival crosssectional shape.

The components of the casing tongs 210 described above form a rigid assembly adapted to be supported from the quill of a top head drive assembly, without relative movement between any of these components during normal operation.

A plurality of jaws 250 are positioned, respectively, in recesses 246 of cam 244. Each of the jaws 50 defines an array of teeth 252 on an inner arcuate cylindrical surface 254. Each of the jaws 250 also defines an outer surface which is ogival in shape and which is shaped to fit into its respective recess 246. The jaws 250 also define pairs of opposed recesses 258, which desirably may have dove-tailed cross-sections when viewed radially, as illustrated by the hidden radially-extending lines in FIGS. 9 and 10. The recesses 258 are oriented radially when the jaws are positioned in the recesses 246, as shown in solid line in FIG. 10.

The jaws 250 are supported in place and rotated with respect to the cam 244 by jaw engaging elements 266, one of which is received in each of the jaw recesses 258. In this embodiment, the jaw engaging elements take the form of elongate keys. Jaw engaging elements 266 are dove-tailed when viewed radially to correspond with the shapes of their respective recesses 258.

Each jaw 250 is provided with a pin 260 that is received in a corresponding groove 262, there being a groove 262 formed in the upper surface of cam 244 at each of the ogival cam surfaces. The cooperation between the pins 260 and the grooves 262 serves to help to retain the jaws 250 in position.

A brake ring assembly 280 includes a brake ring 270 in the form of a brake drum. The brake drum is mounted by an upper assembly ring 282 and a lower assembly ring 284. In this embodiment, at least four bolts 268, one being disposed radially outwardly of each jaw 250, cooperate with a corresponding number of spacers 286 to separate the upper and lower assembly rings 282, 284. Each bolt 268 passes through the rings 282, 284, through a spacer 286, and through a jaw engaging element 266. The jaw engaging elements 266 are loosely positioned within the slots 258 of the jaws 250 and extend radially outward for reception in dove-tailed openings in the spacers 286. In this way, the jaws 250 are engaged with the brake ring assembly 280 and its brake ring 270 for rotation, yet the jaws 50 are free to move radially.

Spring pins 272 are mounted to the interior of the tube 212 and to the jaws 250. Springs 274 mounted between respective pairs of the spring pins 272 resist extension and bias the jaws 250 to the retracted position shown in solid line in FIG. 10. In the retracted position, the jaws 250 are centered in the respective recesses 246.

Preferably, the lower assembly ring 284 has a sufficient width in the radial direction to form a substantially annular shield 288 extending partially inwardly in a direction from the tube toward the central axis, preferably as far as is reasonably practical while still permitting the free passage of the casing collar C of a length of casing. The shield 288 serves to help prevent damage to the portions of the casing tongs that are disposed within the tube 212 through accidental contact with the casing as the casing tongs are being lowered or raised with respect to a length of casing. In addition, the shield 288 helps to retain any miscellaneous loose items that may be present within the tube 212 and that otherwise might fall down the hole being drilled.

Each of two brake mechanisms 290 (FIG. 10) having a brake shoe 292 is mounted to a non-rotating member 80 of the top head drive assembly 104 so as not to rotate with the quill 108. In use, two such mechanisms 290 are mounted at diametrically opposite positions with respect to the tongs 210, so as to provide balanced transverse force during braking. One mechanism 290 will be described.

A track 294 having a T-shaped cross-section is fixed on non-rotating member 80. The vertical position of the brake mechanism 290 with respect to the framing member 80 is adjustable, as provided by bolts 296 threaded into clamps 297. The bolts 296 pass through a base 298 that mounts an air actuator 300 and gussets 302. Cross-member 304 mounts the brake shoe 292 and moves radially of the tube 212 under the control of air actuator 300, which is governed by air pressure at air inlet 306. Springs 308 bias the cross-member 304 in retraction. Desirably, that portion of the cross-member 304 that is disposed between the gussets 302 is sufficiently thick in the direction normal to the drawing that its travel in the left and right directions as seen in the drawing is restrained by the gussets 302, while the extreme ends of the cross-member 304 are sufficiently thin that they may extend outwardly for engagement with the springs 308.

In use, the brake mechanism 290 is positioned to engage the brake ring 270 frictionally, with the brake shoe 292 bearing directly on the brake ring 270.

When the brake mechanism 290 is released and no casing is positioned within the casing tongs 210, the springs 274 bias jaws 250 to a retracted position. When it is desired to grip a length of casing with the casing tongs 210, the top head drive assembly 204 is lowered so as to lower the casing tongs 210 over the upper end of the casing. At this point, the casing is supported by other means such as a transfer arm or slip strand (not shown). Preferably, the tube 212 is dimensioned to ensure that the collar C can fit entirely within the tube 212 such that the jaws 250 engage the casing body B rather than the casing collar C. In this way, torque can be applied directly to the casing body B.

If necessary, an adjustment is made as described above in the vertical positioning of the brake mechanism 290 with respect to the framing member 80 and brake ring 270. The brake mechanism 290 is then set and the top head drive assembly 104 is used to rotate the casing tongs 210 in the appropriate direction either to make up or break out the casing body B. The drag of the brake mechanism 276 on the brake ring 270 shifts the brake ring 270 and therefore also shifts the jaw engaging elements 266 and the jaws 250 with respect to the cam 244 to the positions shown in phantom in FIG. 10. In this way, the jaws 250 are moved out of the recesses 246 toward the casing body B. This inward movement of the jaws 250 continues until the teeth 252 engage the exterior of the casing body B. At this point, the jaws 250 become self-applying, and they securely grip the casing body B. Preferably, the brake is released at this time. The top head drive assembly 104 can then be used to supply the desired torque at the desired rotational speed so as to make up or break out the casing body B with the collar of another length of casing (not shown) situated adjacent the lower end of the casing body B.

When the casing body B is to be released, the brake mechanism 290 is re-applied and the top head drive assembly 104 is controlled to rotate the casing tongs 210 a short distance in the reverse direction. This reverse rotation releases the jaws 250 from the casing body B, thereby allowing the springs 274 to return the jaws 250 to the retracted position shown in solid line in FIG. 10.

It should be recognized that the recesses 258 and the jaws 250 are configured to grip the casing body B in either the make up or break out direction. Thus, the casing tongs 21O are fully bidirectional.

Variations on the embodiments described above are possible. For example, the embodiment of FIGS. 1–6 may be modified to use a brake ring 270 in the form of a brake drum in place of the brake ring 70 in the form of a brake disk. The modification is accomplished by the simple expedient of enlarging the outer tabs 64 of the upper and lower shift rings 60, 62, or otherwise providing for substantially equal upper and lower diameters, and attaching the brake ring 270.

In another variation, the hydraulic disk brake actuator 76 of the embodiment of FIGS. 1–8 may be mounted on framing member 80 for vertical adjustment of the type shown in FIG. 10.

In yet a further variation, the brake mechanism 290 of a type having a brake shoe 292 may be replaced by a brake band type of brake mechanism of known construction, wherein a brake band is wrapped around the brake ring 270.

One difficulty that has been associated with the operation of any of the embodiments described above arises from the fact that the collar C of a length of casing and the adjacent portion of the casing body B to be gripped are disposed at a height substantially above a surrounding walking surface. Yet the desired mode of operation of the casing tongs depends upon lowering the tongs onto the casing to the appropriate position. In particular, it is desirable to lower the casing tongs 210 a sufficient distance that the jaws 50, 250 will grip the body B in preference to the collar C, yet it is desirable not to lower the tongs 210 so far that there is an accidental contact between the collar C and the seal plug 36, adaptor 222, or the like.

In order to assist the proper positioning of the tongs 10, 210, they may be provided with indicating means of the current invention for indicating the relative vertical positioning of the tube or adaptor or the like and the top of the length of casing.

The presently preferred embodiment of indicating means is shown in FIG. 9.

Visual indicating means 310 includes a bracket 312 fixed on the outside of tube 212. Bracket 312 pivotally mounts a lever 314. A first portion 316 of the lever 314 extends through an opening 320 in the side of tube 212. A second portion 318 of lever 314 is disposed so as to be visible from the outside of tube 312. Spring 322 biases lever 314 to the position shown in solid line in the drawing, wherein the first portion 316 is at a lowest position.

First portion 316 of lever 314 extends inwardly of tube 212 a sufficient distance to make contact with the top of a collar C of a length of casing when the tongs are lowered onto the length of casing. Such contact will move the lever in a continuous manner as the tongs are lowered, thereby causing the second portion 318 of lever 314 to provide a continuous visual indication of the relative vertical positioning of the tube 212 and top of the length of casing. For improved operation, highly visible indicia 324 may be provided on lever 314.

In this manner, it is possible to know when the jaws 50, 250 have been lowered a sufficient distance to grip the body B of the casing in preference to the collar C, yet not so far as to cause an undesired contact between the collar C and a seal plug 36, adaptor 222, or the like, thereby avoiding thread damage. Preferably, lever 314 is non-linear, such as the bell-crank shape shown. It is thought that the illustrated shape provides a more discernible visual observation when viewed from below than would be available if the lever 314 were merely linear.

The embodiments described above provide a number of significant advantages. Because the casing tongs are suspended from the quill 108, no external prime mover is required to rotate the casing body B. Rather, the top head drive assembly 104 can be used for this purpose. Furthermore, as described above, the casing tongs 10, 210 are well suited for remote control, thereby minimizing the exposure of operating personnel to the dangers of moving pipe, tools, and the like. Since the casing tongs 10, 210 grip the upper end of the casing body B, excellent blowout protection is provided. In the event of a threatened blowout, the casing body B is clamped (as for example with slips, (not shown), the jaws 50, 250 are released as described above, and then the top head drive assembly 104 is used to thread the seal plug 36, adaptor 222, or the like into the upper end of the casing collar C. Once seated, the seal plug 36 or the like prevents drilling fluid from escaping from the casing, and drilling fluid can then be forced into the casing body B via the quill 106, the passageway 24, 224 and the injector tube 28, 228 so as to control the threatened blowout.

As yet another advantage, the casing tongs 10, 210 are automatically centered on the drilling axis because the casing tongs are mounted directly to the quill 108. Thus, the casing tongs 10, 210 are reliably centered without requiring specialized mounting devices. Furthermore, since the casing tongs 10, 210 are mounted on the top head drive assembly 104, space requirements on the drilling floor of the drilling machine are minimized.

As should be apparent from the foregoing description, the casing tongs 10, 210 are relatively small, uncomplicated, and inexpensive, and are relatively simple to construct and to maintain.

For example, in the first embodiment the disc brake 76 is readily accessible for maintenance. Similarly, various components can be removed and replaced when necessary via the access ports 18, without requiring major disassembly of the casing tongs 10. In this way, the upper shift ring 60 and the jaws 50 can be replaced simply and quickly. The entire assembly is well suited for high-speed automatic operation.

The second embodiment is made from a fewer number of parts and is thought to be even easier to service than the first embodiment. It also is less susceptible to damage by accidental contact with a length of casing or to allowing the accidental loss of loose parts down the hole being drilled.

The changeable vertical positioning of the brake mechanism allows for quick and easy adjustment where, for example, the positioning of the tongs with respect to the top head drive changes by the addition of an adaptor sub, a thread-saving sub or the like. In fact, the second embodiment is thought to be particularly useful in cases where a thread-saver sub is used. Moreover, the typical six inch vertical width of brake drum 270 can accommodate greater variance between the positioning of the tongs and the brake mechanism than when a disc brake is used. If needed, this height can be made even greater by the simple expedient of increasing the vertical dimensions of the brake drum 270, the spacers 286 and the bolts 268. Finally, the relative vertical positioning between the brake mechanism and the drum is simply less critical than in the disk brake embodiment.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of this invention.

We claim:

1. Casing tongs for a drilling machine of the type comprising a mast and a top head drive assembly movable along the mast, wherein the top head drive assembly comprises a quill and means for rotating the quill, said casing tongs comprising:

a rigid tube having an upper end and a lower end, said tube being sized to receive and surround an upper end of a length of casing which comprises a casing collar and a casing body;

a first element secured to the upper end of the tube and shaped to engage the quill to support the tube from the quill such that rotation of the quill causes rotation of the tube;

a plurality of jaws, each configured to engage an exterior surface of the length of casing;

means for supporting the jaws in the tube for limited rotational and radial movement to engage the casing body below the casing collar, said supporting means comprising a plurality of cams, each cam being positioned adjacent a respective one of the jaws and each cam being shaped to shift the respective jaw radially in response to relative rotation between the cam and the respective jaw;

brake means, coupled between the jaws and a nonrotating element external to the tube, for selectively retarding rotation of the jaws when the tube is rotated by the quill and the brake means is set;

said supporting means and brake means cooperating to shift the jaws radially inwardly to clamp the casing body for rotation when the tube is rotated by the quill and the brake means is set.

2. The invention of claim 1 wherein the brake means comprises:

a brake ring mounted to the jaws to rotate with the jaws, said brake ring situated outside the tube; and a brake mechanism secured to the nonrotating element, said brake mechanism comprising a friction pad positioned to engage the brake ring frictionally.

3. The invention of claim 1 wherein said first element defines a bore extending therethrough to receive drilling fluid from the quill, wherein the upper end of the casing collar is threaded, and wherein the invention further comprises:

a second element secured to the first element to threadedly engage with and seal against the upper end of the casing collar, said second element shaped to admit drilling fluid from the bore into the casing body when the second element is engaged with the upper end of the casing collar.

4. The invention of claim 1 further comprising spring means coupled to the jaws to bias the jaws to a retracted position, out of engagement with the casing body.

5. The invention of claim 1 wherein the cams are positioned to shift the jaws into contact with the casing body when the brake means is set and the tube is rotated in either direction by the quill 6. The invention of claim 1 wherein each of the jaws defines an arcuate inner surface shaped to engage the casing body and an ogival outer surface shaped to engage the respective cam.

7. Casing tongs for a drilling machine of the type comprising a mast and a top head drive assembly movable along the mast, wherein the top head drive assembly comprises a quill and means for rotating the quill, said casing tongs comprising:

a tube having an upper end, a lower end, and a side wall;

a quill connector body having an upper end, a lower end, and a passageway extending therebetween, the upper end of the quill connector body shaped to engage and mate with the quill and the lower end of the quill connector body shaped to fit within an upper end of a length of casing which comprises a casing body and a casing collar;

means for rigidly mounting the quill connector body to the upper end of the tube;

a seal plug mounted to the lower end of the quill connector body and shaped to engage and seal against the upper end of the casing collar;

an injector tube secured to the lower end of the quill connector body in alignment with the passageway to conduct drilling fluid from the passageway into the casing body;

a plurality of cams positioned within the tube and rigidly secured to the lower end of the tube, said cams defining a plurality of recesses arrayed around a central opening sized to admit the casing collar into the tube;

a plurality of jaws, each positioned in a respective one of the cam recesses and each defining a respective inner surface shaped to engage the casing body;

a brake ring disposed around the tube outside the tube;

means for coupling the brake ring to the jaws such that the brake ring and the jaws rotate together yet radial movement of the jaws with respect to the brake ring is accommodated;

a disc brake mounted to a nonrotating element outside the tube to frictionally retard rotation of the brake ring when the tube is rotated by the quill; and spring means coupled to the jaws to bias the jaws to a retracted position, out of contact with the casing body;

said disc brake and brake ring cooperating with the cam to move the jaws into engagement with the casing body when the brake is set and the tube is rotated in either direction by the quill, thereby causing the jaws to grip the casing body for rotation by the top head drive assembly.

8. The invention of claim 7 wherein the seal plug defines a first set of splines, wherein the quill connector body defines a second set of splines, and wherein the first and second sets of splines interengage with one another to permit ready removal and installation of the seal plug.

9. The invention of claim 7 wherein the side wall defines at least one opening therein to facilitate assembly of the means for coupling the brake ring to the jaws.

10. The invention of claim 7 wherein each of the jaws defines at least one slot, and wherein the means for coupling the brake ring to the jaws comprises at least one shift ring attached to the brake ring, which shift ring defines a plurality of jaw engaging elements, each mounted to slide within a respective one of the slots.

11. The invention of claim 7 wherein the spring means comprises a plurality of springs, each mounted between the tube and a respective one of the jaws.

12. The invention of claim 7 wherein each of the jaws defines an outer surface which is ogival in shape.

13. Casing tongs for a drilling machine of the type comprising a mast and a top head drive assembly movable along the mast, wherein the top head drive assembly comprises a quill and means for rotating the quill, said casing tongs comprising:

a rigid tube having an upper end and a lower end, said tube being sized to receive and surround an upper end of a length of casing which comprises a casing collar and a casing body;

means for securing the upper end of the tube to the top head drive assembly such that the tube is suspended therefrom and rotation of the quill causes rotation of the tube about a central axis;

a plurality of jaws, each configured to engage an exterior surface of a length of casing;

means for supporting the jaws in the tube for limited rotational and radial movement to engage the casing body below the casing collar, said supporting means comprising a plurality of cams, each cam being positioned adjacent a respective one of the jaws, each cam being shaped to shift the respective jaw radially in response to relative rotation between the cam and the respective jaw; and brake means, coupled between the jaws and a non-rotating element external to the tube, for selectively retarding rotation of the jaws when the tube is rotated by the quill and the brake means is set, said supporting means and brake means cooperating to shift the jaws radially inwardly to clamp a casing body for rotation when the tube is rotated by the quill and the brake means is set.

14. The invention of claim 13, wherein the brake means comprises:

a brake ring mounted to the jaws to rotate with the jaws; and a brake mechanism secured to the non-rotating element, said brake mechanism comprising a friction pad positioned to engage the brake ring frictionally.

15. The invention of claim 14, further comprising means for releasably and adjustingly mounting the brake mechanism in a plurality of vertical dispositions with respect to the non-rotating element.

16. The invention of claim 13, wherein the brake means comprises:

a brake disc mounted to the jaws to rotate with the jaws, the brake disc being disposed outside the tube; and a disc brake mechanism secured to the nonrotating element, the disc brake mechanism comprising a friction pad positioned to engage the brake disc frictionally.

17. The invention of claim 13, wherein the brake means comprises:

a brake drum mounted to the jaws to rotate with the jaws, the brake drum being disposed outside the tube; and a brake shoe mechanism secured to the non-rotating element, the brake shoe mechanism comprising a brake shoe positioned to engage the brake drum frictionally.

18. The invention of claim 13, wherein the cams are positioned to shift the jaws into contact with a casing body when the brake means is set and the tube is rotated in either direction by the quill.

19. The invention of claim 13, wherein each of the jaws defines at east one slot, and wherein the means for coupling the brake ring to the jaws comprises at least one shift ring attached to the brake ring, the shift ring defining a plurality of jaw engaging elements, each jaw engaging element being mounted to slide within a respective one of the slots.

20. The invention of claim 13, wherein each of the jaws defines at least one slot, further comprising a plurality of jaw engaging elements mounted to slide within a respective one of the slots, each jaw engaging element being so connected to the brake ring that retarding of the brake ring causes the jaw engaging elements to retard rotation of the jaws about the central axis.

21. The invention of claim 13, further comprising spring means coupled to the jaws to bias the jaws to a retracted position, out of engagement with a casing body.

22. The invention of claim 13, wherein each of the jaws defines an arcuate inner surface shaped to engage a casing body and an ogival outer surface shaped to engage the respective cam.

23. The invention of claim 13, further comprising a substantially annular member disposed coaxially of the tube and securing the cams against longitudinal movement with respect to the tube.

24. The invention of claim 13, further comprising a substantially annular shield disposed coaxially of the tube and proximate the lower end thereof, the shield extending partially inwardly in a direction from the tube toward the central axis.

25. The invention of claim 13, further comprising indicating means for indicating relative vertical positioning of the tube and the top of a length of casing.

26. The invention of claim 25, said indicating means comprising visual indicating means for providing a continuous visual indication of the relative vertical positioning of the tube and the top of a length of casing over a range of vertical travel of said top head drive assembly.

27. The invention of claim 25, said indicating means comprising a lever, a first portion of the lever extending into the tube for contact with the top of a length of casing, a second portion of the lever being disposed so as to be visible from outside the tube.

28. The invention of claim 13, further comprising a mating element defining a passageway extending therethrough to receive drilling fluid from the quill, the mating element comprising attachment means for establishing said suspension of said tube from said top head drive assembly.

29. The invention of claim 28, further comprising a seal plug secured on the mating element, the seal plug bearing external threads sized and disposed for threaded engagement with the threads of a casing collar whenever the tube is sufficiently lowered for said engagement.

30. The invention of claim 28, wherein the mating element comprises external threads sized and disposed for threaded engagement with the threads of a casing collar whenever the tube is sufficiently lowered for said engagement.

31. The invention of claim 28, further comprising an injector tube secured to a lower end of the mating element and being in fluid communication with the quill and the passageway of the mating element to conduct drilling fluid into a length of casing.

32. The invention of claim 28, further comprising an annular plate having a hole formed therein, the annular plate being secured on the upper end of the tube, the mating element being disposed in splined engagement in the hole of the annular plate, the mating element being releasably secured to the annular plate.

* * * * *